US010261534B2

(12) United States Patent
Nabicht et al.

(10) Patent No.: US 10,261,534 B2
(45) Date of Patent: Apr. 16, 2019

(54) METHOD AND SYSTEM FOR AN ADAPTIVE LOW-DROPOUT REGULATOR

(71) Applicant: Entropic Communications, LLC., Carlsbad, CA (US)

(72) Inventors: Joseph Nabicht, Carlsbad, CA (US); Branislav Petrovic, Carlsbad, CA (US)

(73) Assignee: Maxlinear, Inc., Carlsbad, CA (US)

( * ) Notice: Subject to any disclaimer, the term of this patent is extended or adjusted under 35 U.S.C. 154(b) by 0 days.

(21) Appl. No.: 14/947,612

(22) Filed: Nov. 20, 2015

(65) Prior Publication Data

US 2016/0085252 A1 Mar. 24, 2016

Related U.S. Application Data

(63) Continuation of application No. 13/947,521, filed on Jul. 22, 2013, now Pat. No. 9,201,436.

(51) Int. Cl.

| | |
|---|---|
| ***G05F 1/00*** | (2006.01) |
| ***G05F 1/575*** | (2006.01) |
| ***G05F 1/56*** | (2006.01) |
| ***G05F 5/00*** | (2006.01) |

(52) U.S. Cl.

CPC ..... *G05F 1/575* (2013.01); *G05F 1/56* (2013.01); *G05F 5/00* (2013.01)

(58) Field of Classification Search

CPC . G05F 1/575; G05F 1/56; G05F 1/573; G05F 1/67

USPC ..... 323/273–281, 299, 303

See application file for complete search history.

(56) References Cited

U.S. PATENT DOCUMENTS

| | | | | |
|---|---|---|---|---|
| 5,680,035 | A * | 10/1997 | Haim | G05F 1/573 323/275 |
| 6,531,851 | B1 * | 3/2003 | Lenk | G05F 1/575 323/280 |
| 6,661,214 | B1 * | 12/2003 | Hann | G05F 1/575 323/280 |
| 2001/0030530 | A1 * | 10/2001 | Marty | G05F 1/565 323/280 |
| 2006/0273771 | A1 * | 12/2006 | van Ettinger | G05F 1/575 323/273 |
| 2010/0156364 | A1 * | 6/2010 | Cho | G05F 1/573 323/280 |
| 2012/0013396 | A1 * | 1/2012 | Morino | G05F 3/24 327/540 |

* cited by examiner

*Primary Examiner* — Nguyen Tran
(74) *Attorney, Agent, or Firm* — McAndrews, Held & Malloy

(57) ABSTRACT

Methods and systems for a low-dropout regulator may comprise a voltage regulator comprising: (a) a pass transistor having a first terminal at a control gate, a voltage input at a second terminal, and a voltage output at a third terminal, and (b) an adaptive control circuit (ACC), electrically coupled to a reference voltage and each of the terminals of the pass transistor. The ACC may determine a ΔV between the second and third terminals and cause an error signal to be applied to the first terminal to keep ΔV essentially constant as the voltage input varies. The ACC may include a voltage summing circuit electrically coupled to the reference voltage and the input voltage to generate a comparison value. An error amplifier electrically coupled to the control gate and to the voltage summing circuit may generate the error signal from the comparison value and the output voltage.

14 Claims, 7 Drawing Sheets

METHOD AND SYSTEM FOR AN ADAPTIVE LOW-DROPOUT REGULATOR

This application is a continuation of application Ser. No. 13/947,521, filed on Jul. 22, 2013. The above stated application is hereby incorporated herein by reference in its entirety.

BACKGROUND (1) Technical Field

This invention relates to electronic circuits, and more particularly to low dropout voltage regulator circuits.

(2) Background

A well-known type of voltage regulator circuit is a low-dropout (LDO) regulator, which is a DC linear voltage regulator which can operate with a very small input-output differential voltage and maintain a (substantially) constant output voltage Vout with respect to a varying input voltage Vin. Advantages of an LDO voltage regulator generally include a low minimum operating voltage and high efficiency operation.

FIG. 1 is a circuit diagram of a typical prior art low dropout voltage regulator circuit 100. The main components of the LDO circuit 100 are an error amplifier 102 and a power field effect transistor (FET) 104. The resistance of the FET 104, and thus the amount of input voltage Vin passed across the FET 104 as an output voltage Vout, is determined by a control signal applied to the gate of the FET 104. The term "dropout" refers to the minimum voltage difference ΔV=Vin−Vout across the FET 104 at which an LDO regulator is still active before going into saturation.

In operation, one input of the error amplifier 102 monitors the fraction of Vout determined by the resistor ratio of R1 and R2. The second input to the differential amplifier is a reference voltage Vref from a stable voltage source (e.g., a bandgap reference). If the output voltage Vout varies too much relative to the reference voltage Vref, the drive to the gate of the FET 104 changes to maintain a constant output voltage regardless of voltage excursions at Vin (within the circuit specifications). Filter capacitors Cin and Cout may be provided at the input and the output of the LDO circuit 100, as is known in the art.

FIG. 2 is graph of input versus output voltage for a typical prior art low dropout voltage regulator circuit of the type shown in FIG. 1. Within the specifications of a particular circuit, variations of Vin from a minimum value Vin_min to a maximum value Vin_max result in an essentially constant voltage output Vout (graph line 202) within the output specification range Vout_min to Vout_max. By design, the Vout target is typically in the middle of the output specification range, or is set closer to the lower specification limit Vout_min to allow the use of higher dropout voltage LDO circuits.

One aspect of the LDO circuit 100 shown in FIG. 1 is that, with increasing input voltage Vin, regulating the output voltage Vout to a fixed value results in increasing ΔV (ΔV=Vin−Vout); that is, as shown in FIG. 2, ΔV (graph line 204) increases proportionally with the input voltage Vin. As a result, the power dissipation Pdissipation inside the LDO circuit 100 also increases proportionally with ΔV, since Pdissipation=I×ΔV, where I is the load current. Such increased dissipation in an LDO circuit is undesirable because it may increase thermal management complexity and cost of an electronic system or larger circuit utilizing one or more LDO circuits. Minimizing power dissipation is particularly important when an LDO circuit is integrated into circuitry that already is dissipating large amounts of power and/or where thermal management is difficult, as in enclosed, fanless applications.

Accordingly, there is thus a need for a low dropout voltage regulator circuit having lower power dissipation than conventional LDO regulator circuits. The present invention addresses this need.

SUMMARY OF THE INVENTION

The invention encompasses an adaptive low dropout voltage regulator circuit having low power dissipation, and a method of regulating voltage while maintaining low power dissipation.

In considering the usage of LDO regulators in practical circuits, it was realized that the output voltage Vout need not be constant, but only need be maintained between the circuit specification parameters Vout_min to Vout_max. Accordingly, power dissipation in an LDO circuit can be controlled and held to a low value in comparison to prior art LDO circuits by designing an LDO circuit that maintains a constant voltage difference between Vin and Vout; that is, ΔV=Vin−Vout is held approximately constant rather than being linearly variable as a function of Vin. Thus, the output voltage Vout essentially tracks the input voltage Vin with an offset equal to ΔV; Vout increases as Vin, but is kept between the Vout_min to Vout_max circuit specification limits. An LDO regulator circuit designed with this concept in mind may be thought of as adapting Vout to Vin within a constrained output voltage range that need not be constant.

In one embodiment, an input voltage Vin is coupled to a pass transistor, which typically is a FET or JFET or a device with comparable characteristics. The resistance of the pass transistor, and thus the amount of input voltage Vin passed across the pass transistor as an output voltage Vout, is determined by a control signal applied to a control gate of the pass transistor. The control gate of the pass transistor is coupled to an error amplifier, the inputs of which are coupled to an adaptive control. The adaptive control is coupled to Vin, Vout, and a reference voltage Vref from a stable voltage source.

The purpose of the adaptive control is to compute or generate ΔV, which is the difference between Vin and Vout, and compare ΔV to Vref. If ΔV (as opposed to Vout) varies too much relative to Vref, the drive to the control gate of the pass transistor changes to maintain an essentially constant ΔV regardless of voltage excursions at Vin, within circuit specifications. A variant of the LDO circuit allows ΔV to vary at high values of Vin to maintain Vout within circuit specifications.

The details of one or more embodiments of the invention are set forth in the accompanying drawings and the description below. Other features, objects, and advantages of the invention will be apparent from the description and drawings, and from the claims.

DESCRIPTION OF THE DRAWINGS

Like reference numbers and designations in the various drawings indicate like elements.

DETAILED DESCRIPTION OF THE INVENTION

The invention encompasses an adaptive low dropout voltage regulator circuit having low power dissipation, and a method of regulating voltage while maintaining low power dissipation.

In considering the usage of LDO regulators in practical circuits, it was realized that the output voltage Vout need not be constant (i.e., the output DC voltage does not need to be fixed), but only need be maintained between the circuit specification parameters Vout_min to Vout_max. Accordingly, power dissipation in an LDO circuit can be controlled and held to a low value in comparison to prior art LDO circuits by designing an LDO circuit that maintains a constant voltage difference between Vin and Vout; that is, ΔV=Vin−Vout is held approximately constant rather than being linearly variable as a function of Vin. Thus, the output voltage Vout essentially tracks the input voltage Vin with an offset equal to ΔV; Vout increases as Vin, but is kept between the Vout_min to Vout_max circuit specification limits. An LDO regulator circuit designed with this concept in mind may be thought of as adapting Vout to Vin within a constrained output voltage range that need not be constant.

Figure 1:
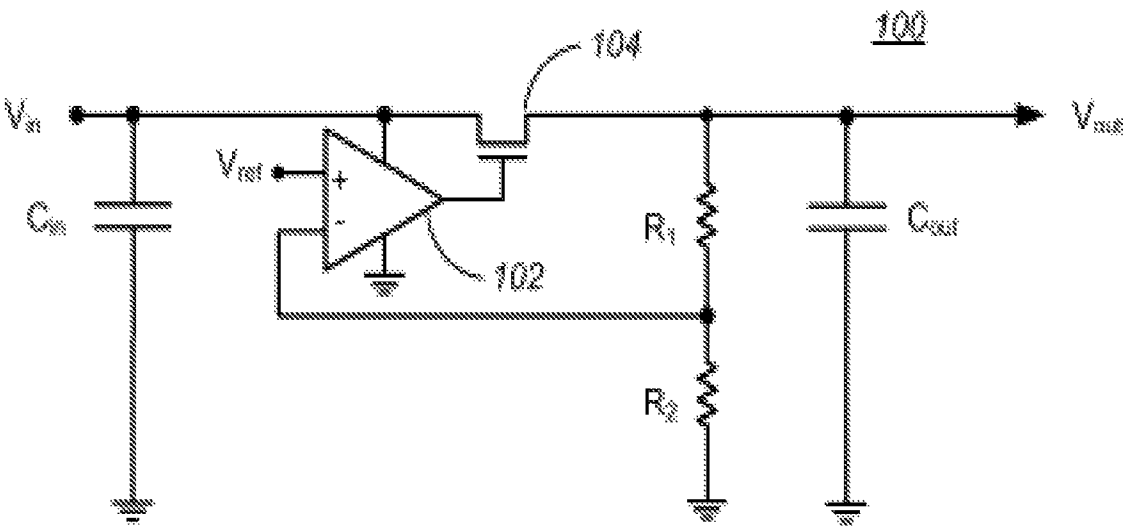
FIG. 1 Prior Art
FIG. 1 is a circuit diagram of a typical prior art low dropout voltage regulator circuit.
Figure 2:
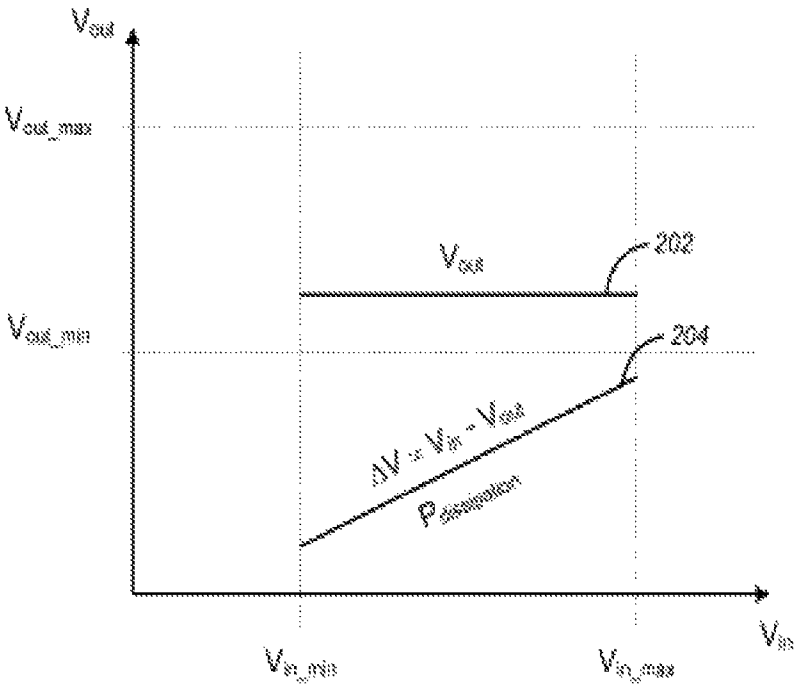
FIG. 2 Prior Art
FIG. 2 is graph of input versus output voltage for a typical prior art low dropout voltage regulator circuit of the type shown in FIG. 1.
Figure 3:
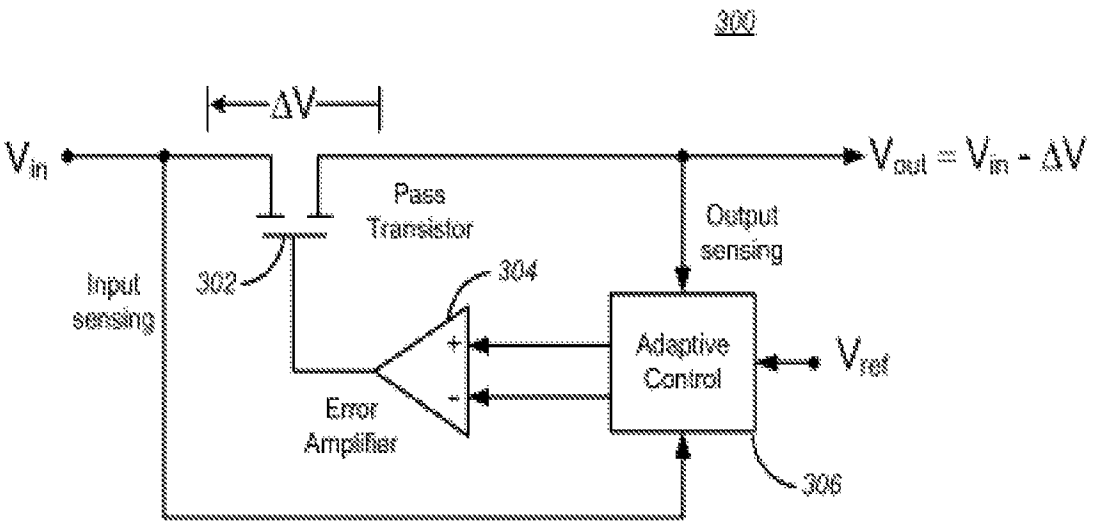
FIG. 3 is a circuit diagram of a generalized adaptive low dropout voltage regulator circuit in accordance with one embodiment of the present invention.

FIG. 3 is a circuit diagram of a generalized adaptive low dropout voltage regulator (LDO) circuit 300 in accordance with one embodiment of the present invention. An input voltage Vin is coupled to a pass transistor 302, which typically is a FET or JFET or a device with comparable characteristics. The resistance of the pass transistor 302, and thus the amount of input voltage Vin passed across the pass transistor 302 as an output voltage Vout, is determined by a control signal applied to a control gate of the pass transistor 302.

The control gate of the pass transistor 302 is coupled to an error amplifier 304, the inputs of which are coupled to an adaptive control 306. The adaptive control is 306 coupled to Vin, Vout, and a reference voltage Vref from a stable voltage source (e.g., a bandgap reference). As in the prior art, filter capacitors (not shown) may be provided at the input and/or the output of the LDO circuit 300. All adaptive LDO circuit 300 components preferably are low power, and preferably much lower cumulatively than the power saved by the disclosed circuit.

The purpose of the adaptive control 306 is to compute or generate ΔV, which is the difference between Vin and Vout, and compare ΔV to Vref (Vref is the target value for ΔV). If the ΔV (as opposed to Vout) varies too much relative to Vref, the drive to the control gate of the pass transistor 302 changes to maintain an essentially constant ΔV regardless of voltage excursions at Vin, within circuit specifications (however, as noted in further detail below, a variant of the LDO circuit 300 allows ΔV to vary at high values of Vin to maintain Vout within circuit specifications).

Figure 4:
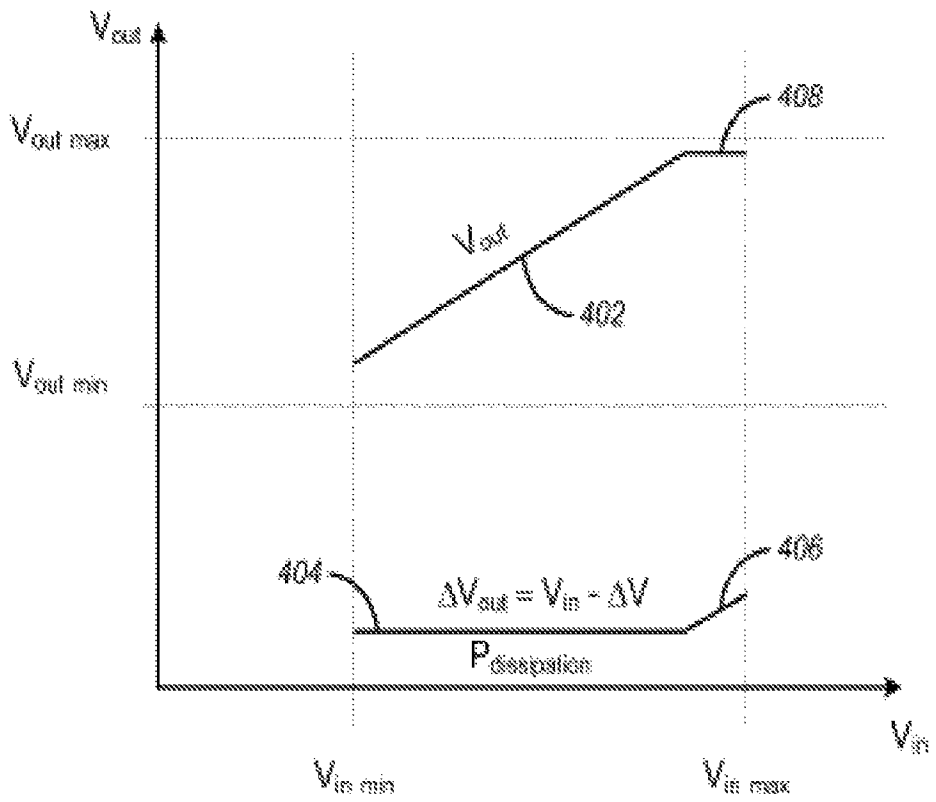
FIG. 4 is graph of input versus output voltage for an adaptive low dropout voltage regulator circuit in accordance with one embodiment of the present invention.

FIG. 4 is graph of input versus output voltage for an adaptive low dropout voltage regulator circuit in accordance with one embodiment of the present invention. While the output voltage Vout (graph line 402) varies with Vin, ΔV is approximately constant. With ΔV (graph line 404) essentially constant, the power dissipation Pdissipation inside the LDO circuit 300 is also essentially constant and substantially independent of Vin: Pdissipation=I*ΔV≈constant (depending on the load, the load current I may slightly increase with increased Vout, slightly increasing the LDO circuit dissipation, but this would be a second order effect).

As should be apparent from FIG. 4, the lower the value of ΔV, the lower the power dissipation. By setting and maintaining ΔV close to the minimum dropout voltage capability of the LDO circuit 300 (below which dropout—that is, saturation and inability to regulate/track—will occur, taking into account a safety margin in the Vin_min specification), a minimum possible power dissipation for a particular embodiment of the LDO circuit 300 can be achieved for all or most of the input voltage range.

In terms of control loop theory, the loop bandwidth of the adaptive LDO circuit 300 is set by the circuit parameters. In the preferred embodiment, the input is tracked inside the loop bandwidth (including DC), and energy outside the loop bandwidth is rejected. Thus, the LDO circuit 300 tracks input voltage within the loop bandwidth (preferred is narrow bandwidth tracking primarily DC) while regulating and rejecting input noise/ripple voltages at frequencies above the loop bandwidth (i.e., the circuit behaves like a low pass filter). Note that this is in contrast to prior art LDO circuits, which behave like high pass filters. If rejection of low frequency energy is desired (e.g., ripple rejection), an averaging circuit or a low pass filter such as an RC filter may be inserted in the input sensing line. This will prevent the loop from tracking the input inside the bandwidth of the RC filter, thus rejecting the energy in that bandwidth. The output will still track the input with a ΔV offset, but will track only (moving) average changes, not rapid (near instantaneous) changes.

Figure 5:
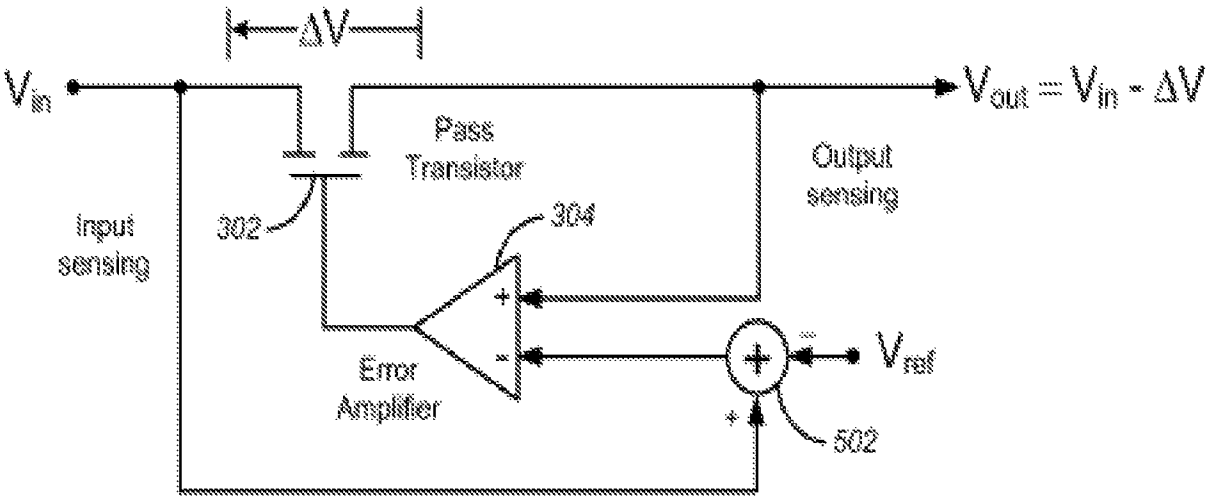
FIG. 5 is a circuit diagram of a first particular adaptive low dropout voltage regulator circuit in accordance with one embodiment of the present invention.

FIG. 5 is a circuit diagram of a first particular adaptive low dropout voltage regulator circuit in accordance with one embodiment of the present invention, showing one implementation of the adaptive control 306 of FIG. 3. In the illustrated embodiment, a Vref voltage and Vin are applied to a conventional voltage summing circuit 502 to generate a difference Vout=Vin−Vref. That desired value for Vout is applied to one input of the error amplifier 304 as shown, and compared to the actual value of Vout applied to the other input of the error amplifier 304. Since Vout=Vin−ΔV, and Vout=Vin−Vref, the error amplifier 304 will drive the pass transistor 302 to keep − the voltage across the + and − terminals of the error amplifier close to zero, and thus ΔV will approximately equal to Vref. In particular, if ΔV varies too much relative to Vref, the drive to the control gate of the pass transistor 302 changes to maintain an essentially constant ΔV.

Figure 6:
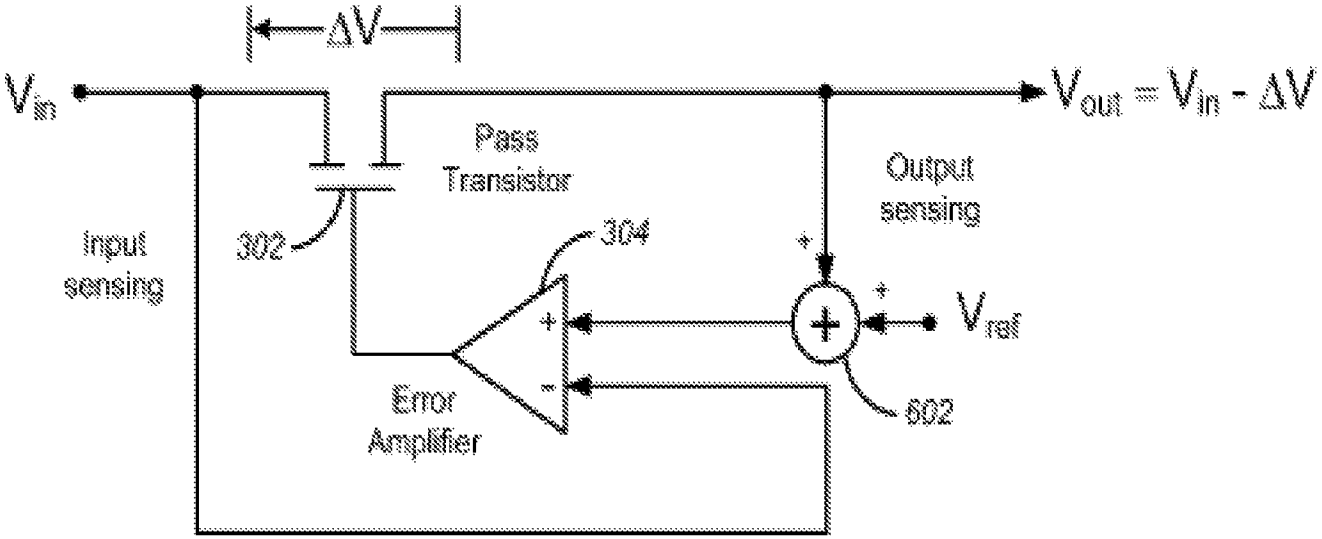
FIG. 6 is a circuit diagram of a second particular adaptive low dropout voltage regulator circuit in accordance with one embodiment of the present invention.

FIG. 6 is a circuit diagram of a second particular adaptive low dropout voltage regulator circuit in accordance with one embodiment of the present invention, showing another implementation of the adaptive control 306 of FIG. 3. In the illustrated embodiment, a Vref voltage and Vout are applied to a conventional voltage summing circuit 602 to generate a sum Vin=Vout+Vref. That desired value for Vout is applied to one input of the error amplifier 304 as shown, and compared to the actual value of Vin applied to the other input of the error amplifier 304. Since Vout+−ΔV=Vin, and Vin=Vout+Vref, the error amplifier 304 will drive the pass transistor 302 to keep −ΔV approximately equal to Vref. As in FIG. 5, if ΔV varies too much relative to Vref, the drive to the control gate of the pass transistor 302 changes to maintain an essentially constant ΔV.

In either of the circuits of FIG. 5 or FIG. 6, an RC filter can be inserted in the input sense line, between Vin and the error amplifier 304, to filter noise and ripple from the input line and provide rejection of such ripple and noise occurring inside the RC filter bandwidth of the loop at Vout.

In either of the embodiments shown in FIG. 5 or FIG. 6, resistive dividers may be used to scale Vin and Vout to be closer to the value of Vref. In any case, good accuracy of Vref and voltage sensing helps achieve more precise targets, maximizing power savings.

Figure 7:
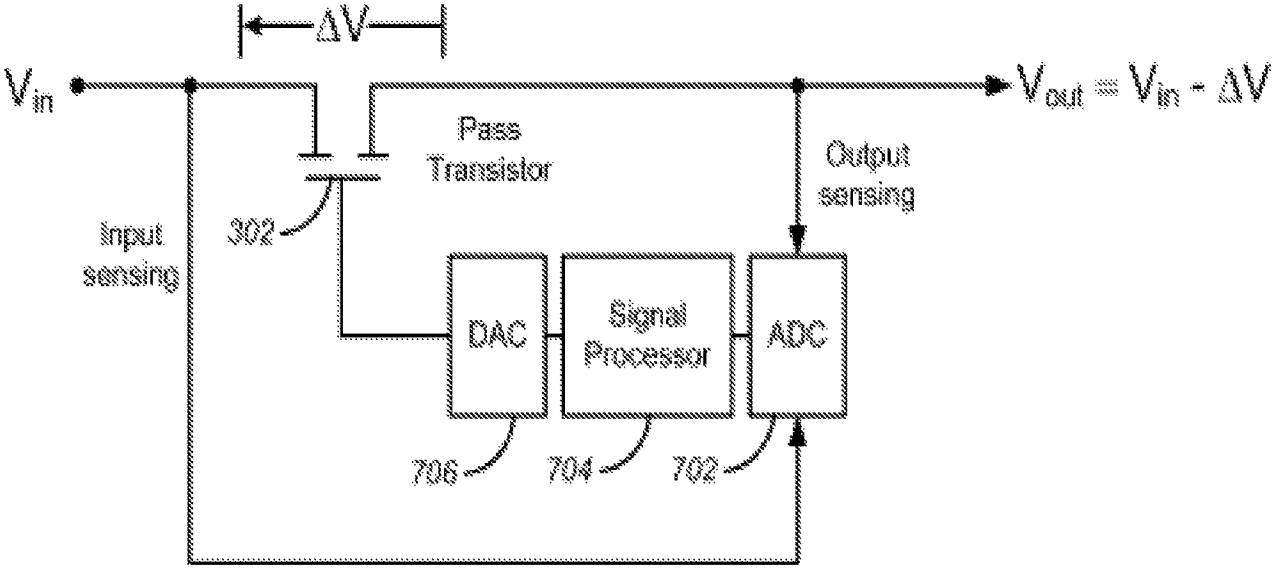
FIG. 7 is a circuit diagram of a third particular adaptive low dropout voltage regulator circuit in accordance with one embodiment of the present invention.

FIG. 7 is a circuit diagram of a third particular adaptive low dropout voltage regulator circuit in accordance with one embodiment of the present invention utilizing a digital adaptive control. In this alternative embodiment, the adaptive control 306 of FIG. 3 may comprise a low frequency/power analog to digital converter (ADC) 702 coupled to a digital signal processor 704, which in turn is coupled to a digital to analog converter (DAC) 706 for driving the control gate of the pass transistor 302 (in this variant, the comparison function of the error amplifier 304 of FIG. 3, and filtering, if any, is performed within the digital signal processor 704). The ADC 702 senses the values of Vin and Vout (the ADC 702 may be either one ADC multiplexing between Vin and Vout, or separate ADCs for Vin and Vout). The digital values of Vin and Vout are then processed in the digital signal processor 704 to compute ΔV, and the loop closed by using the DAC 706 to govern the control gate of the pass transistor 302 as a function of ΔV. In this configuration, a separate Vref signal is not needed, since ΔV can be directly computed; it is implied that the ADC and DAC will have their own reference necessary for conversions.

Using a digital adaptive control provides additional flexibility to the circuit, such as by allowing taking into account a measured temperature of the LDO circuit 300 and/or the ambient temperature, and letting the power dissipation increase if the excess heat can be tolerated in view of such measurements.

Referring again to FIG. 4, the graph shows that, by a suitable implementation of the adaptive control 306, the LDO circuit 300 can be configured so that if Vout (=Vin−ΔV) approaches the upper specification limit Vout_max, then the circuit starts ramping up ΔV (graph line 406) so that Vout is kept below the Vout_max (graph line 408). Thus, when Vout approaches the Vout_max specification limit (within a margin), the error signal transitions from being derived by comparing ΔV to Vref, to being derived by comparing Vout with Vref in order to maintain Vout at or below Vout_max. Implementing such a transition point is readily accomplished using the ADC/DAC embodiment discussed above with respect to FIG. 7. In this case, a soft, gradual transition between the two states can be achieved. Alternatively, the transition to constant-output voltage mode (i.e., a conventional mode of controlling Vout so as not to exceed the Vout_max specification) can be achieved by cutting off the Vin feed to the error amplifier 304 and changing Vref (e.g., by changing the scaling of Vref, or scaling Vout) to the requisite value for the target value of Vout. This transition action may be triggered by a Vout sensing circuit (not shown) comprising a comparator with hysteresis to prevent chattering and absorb any Vout changes due to inaccuracies in sensing/scaling of the voltages.

As an example of the advantages of the invention over the prior art for particular embodiments, consider a circuit specification requiring the following values: Vin_min=5.1V, Vin_max=5.6V; Vout_min=4.8V, Vout_max=5.3V. Assuming a 0.2V dropout LDO pass transistor and 100 mA load current, then the following results are typical:

Prior art circuit:

Vout=4.9V (0.1V above the Vout_min, achievable with the given dropout voltage);

LDO Pdissipation at Vin_min=0.2V*100 mA=20 mW;

LDO Pdissipation at Vin_max=0.7V*100 mA=70 mW.

For an embodiment of the adaptive LDO in accordance with the present invention:

Vout=4.9V at Vin_min;

LDO Pdissipation at Vin_min=0.2V*100 mA=20 mW;

Vout=5.3V at Vin_max;

LDO dissipation at Vin_max=0.3V*100 mA=30 mW.

Thus, an embodiment of the present invention can achieve more than a factor of two improvement in power dissipation at Vin_max, saving 40 mW in the above example (70 mW for the prior art circuit versus 30 mW for the example embodiment of the present invention). Of note, the savings scales up with current: for example, with a 1 A load, the saving is 400 mW, which is particularly significant for integrated circuit embodiments of the invention. Quite importantly, the prior art circuit will consume more power for any excursion of Vin above Vin_min, while the adaptive LDO of the present invention stays at minimum power dissipation for most values of Vin, rising only as Vin approaches fairly closely to Vin_max (if the circuit is designed to allow ΔV to vary at higher input voltages, as described above).

The invention also encompasses several methods of regulating voltage while maintaining low power dissipation. In one embodiment, the method includes:

determining the difference ΔV between a voltage input to a pass transistor and a voltage output of the pass transistor; and controlling the power dissipation of the pass transistor as a function of ΔV so as to maintain such power dissipation approximately constant as the voltage input varies.

In another embodiment, the method of regulating voltage includes:

determining the difference ΔV between a voltage input to a pass transistor and a voltage output of the pass transistor; and controlling the pass transistor as a function of ΔV so as to maintain ΔV approximately constant as the voltage input varies.

In still another embodiment, the method of regulating voltage includes:

providing a pass transistor having a control gate, a voltage input, and a voltage output;

providing adaptive control circuitry, electrically coupled to the control gate of the pass transistor, the voltage input, and the voltage output, for determining the difference ΔV between the voltage input to the pass transistor and the voltage output of the pass transistor; and applying an error signal derived from the adaptive control circuitry to the control gate of the pass transistor to keep ΔV essentially constant as the voltage input varies.

These methods may further include filtering the voltage input before determining ΔV in order to track only moving average changes to the voltage input, as noted with respect to the circuit description above.

A number of embodiments of the invention have been described. It is to be understood that various modifications may be made without departing from the spirit and scope of the invention. For example, some of the steps described above may be order independent, and thus can be performed in an order different from that described. It is to be understood that the foregoing description is intended to illustrate and not to limit the scope of the invention, which is defined by the scope of the following claims, and that other embodiments are within the scope of the claims.

What is claimed is:

1. A system for voltage regulation, the system comprising:

a voltage regulator comprising:

a pass transistor having a first terminal at a control gate, a voltage input at a second terminal, and a voltage output at a third terminal; and an adaptive control circuit comprising a voltage summing circuit, with a first input of the voltage summing circuit connected to a reference voltage and a second input of the voltage summing circuit connected to the second terminal of the pass transistor, and an output of the voltage summing circuit connected to an input of an error amplifier that has an output connected to the first terminal of the pass transistor, the adaptive control circuit being operable to:

determine a difference ΔV between the second and third terminals of the pass transistor;

sum the reference voltage and the input voltage using the voltage summing circuit, thereby generating a comparison value;

generating an error signal from the comparison value and the voltage output using the error amplifier; and applying the error signal to the first terminal of the pass transistor to keep ΔV essentially constant and allow an output voltage at the third terminal to vary as the voltage input varies.

2. The system of claim 1, wherein the voltage regulator is operable to filter the voltage input before determining ΔV in order to track only moving average changes to the voltage input.

3. The system of claim 1, wherein the pass transistor comprises a metal-oxide semiconductor transistor.

4. The system of claim 1, wherein the reference voltage comprises a bandgap reference.

5. The system of claim 1, wherein the voltage regulator acts as a low-pass filter, regulating input voltages within a loop bandwidth and rejecting input noise and/or ripple voltages above the loop bandwidth.

6. A method of voltage regulation, the method comprising:

in a voltage regulator comprising a pass transistor having a first terminal at a control gate, a voltage input at a second terminal, and a voltage output at a third terminal:

determining a difference ΔV between the second and third terminals of the pass transistor utilizing an adaptive control circuit connected to a reference voltage and to the first terminal of the pass transistor, the adaptive control circuit comprising a voltage summing circuit, with a first input of the voltage summing circuit connected to a reference voltage and a second input of the voltage summing circuit connected to the second terminal of the pass transistor, and an output of the voltage summing circuit connected to an input of an error amplifier that has an output connected to the first terminal of the pass transistor;

generating a comparison value using the voltage summing circuit;

generating an error signal using the error amplifier from the comparison value and the output voltage; and controlling power dissipation of the pass transistor as a function of ΔV utilizing the adaptive control circuit by applying the error signal to the first terminal of the pass transistor so as to maintain such power dissipation approximately constant and allow the voltage output at the third terminal to vary as the voltage input varies.

7. The method of claim 6, comprising filtering the voltage input before determining ΔV in order to track only moving average changes to the voltage input.

8. The method of claim 6, wherein controlling the power dissipation of the pass transistor as a function of ΔV comprises maintaining ΔV approximately constant as the voltage input varies.

9. The method of claim 6, wherein the pass transistor comprises a metal-oxide semiconductor transistor.

10. The method of claim 6, wherein the reference voltage comprises a bandgap reference.

11. A method of regulating voltage in an adaptive low dropout voltage regulator circuit while maintaining low power dissipation, including:

providing a pass transistor having a first terminal at a control gate, a voltage input at a second terminal, and a voltage output at a third terminal;

providing adaptive control circuitry comprising a voltage summing circuit, with a first input of the voltage summing circuit connected to a reference voltage and a second input of the voltage summing circuit connected to the second terminal of the pass transistor, and an output of the voltage summing circuit connected to an error amplifier that has an output connected to the first terminal of the pass transistor, the adaptive control circuitry for determining a difference ΔV between the second and third terminals of the pass transistor;

generating a comparison value using the voltage summing circuit;

generating an error signal using the error amplifier from the comparison value and the output voltage; and applying the error signal derived from the adaptive control circuitry to the control gate of the pass transistor to keep ΔV essentially constant and allow the voltage output at the third terminal to vary as the voltage input varies.

12. The method of claim 11, comprising filtering the voltage input before determining ΔV in order to track only moving average changes to the voltage input.

13. The method of claim 11, wherein the reference voltage comprises a bandgap reference.

14. The method of claim 11, wherein the pass transistor comprises a metal-oxide semiconductor transistor.

* * * * *